US009802073B2

(12) United States Patent
Pawlas et al.

(10) Patent No.: US 9,802,073 B2
(45) Date of Patent: Oct. 31, 2017

(54) VARIABLE WEIGHT KETTLEBELL

(71) Applicant: GProducts LLC, Louisville, CO (US)

(72) Inventors: Gary E. Pawlas, Louisville, CO (US); Stefan Asara Berkower, Boulder, CO (US); Jonathan Nicholas Peot, Modesto, CA (US)

(73) Assignee: GProducts LLC, Louisville, CO (US)

( * ) Notice: Subject to any disclaimer, the term of this patent is extended or adjusted under 35 U.S.C. 154(b) by 0 days.

(21) Appl. No.: 15/458,748

(22) Filed: Mar. 14, 2017

(65) Prior Publication Data

US 2017/0259106 A1 Sep. 14, 2017

Related U.S. Application Data

(63) Continuation of application No. 15/453,766, filed on Mar. 8, 2017.

(60) Provisional application No. 62/305,244, filed on Mar. 8, 2016.

(51) Int. Cl.
*A63B 21/00* (2006.01)
*A63B 21/075* (2006.01)

(52) U.S. Cl.
CPC ..... *A63B 21/075* (2013.01); *A63B 21/4035* (2015.10)

(58) Field of Classification Search
CPC ..... A63B 21/0004; A63B 21/00058; A63B 21/00061; A63B 21/00065; A63B 21/00069; A63B 21/00072; A63B 21/00185; A63B 21/06; A63B 21/062; A63B 21/0626; A63B 21/0628; A63B 21/063; A63B 21/0632; A63B 21/072; A63B 21/0722; A63B 21/0724; A63B 21/0726; A63B 21/0728; A63B 21/075; A63B 21/4023; A63B 21/4027; A63B 21/4033; A63B 21/4035; A63B 21/4043; A63B 71/0054; A63B 2071/0063; A63B 2071/0072; A63B 2071/0081; A63B 2071/009; A63B 2244/09
See application file for complete search history.

(56) References Cited

U.S. PATENT DOCUMENTS 1,316,683 A * 9/1919 Calvert ..... A63B 21/072 473/125
1,917,566 A * 7/1933 Wood ..... A63B 21/075 482/108

(Continued)

OTHER PUBLICATIONS

Amazon, "Gold's Gym Extreme 20 lb Adjustable Kettle Bell", Retrieved from https://www.amazon.com/Golds-Extreme-Adjustable-Kettle-Bell/dp/B00FQT3VZ6, Known to exist as early as Jan. 30, 2017, p. 5.

(Continued)

*Primary Examiner* — Loan H Thanh
*Assistant Examiner* — Gary D Urbiel Goldner
(74) *Attorney, Agent, or Firm* — Neugeboren O'Dowd PC

(57) ABSTRACT

A kettlebell may comprise a main body configured to retain one or more removable exercise weights and a handle connected to the main body at two attachment points on a top side of the main body. The main body may have an opening disposed on the top side and between the two attachment points configured to receive the one or more removable exercise weights.

19 Claims, 15 Drawing Sheets

(56) References Cited

U.S. PATENT DOCUMENTS 4,431,185 A * 2/1984 Cisneros ..... A63B 21/072 220/318
6,387,022 B1 * 5/2002 Smith ..... A63B 43/02 482/106
7,052,445 B2 * 5/2006 Ekhaus ..... A63B 21/072 482/108
7,381,157 B2 * 6/2008 Blateri ..... A63B 21/075 482/106
7,491,157 B1 * 2/2009 Lin ..... A63B 21/0728 482/107
7,563,208 B1 * 7/2009 Chen ..... A63B 21/075 482/108
D616,949 S * 6/2010 Wang ..... D21/682
8,033,965 B1 * 10/2011 Krull ..... A63B 21/072 482/107
8,636,625 B2 * 1/2014 Johnson ..... A63B 21/072 482/44
9,022,906 B1 * 5/2015 Nelson ..... A63B 21/075 482/106
9,327,159 B1 * 5/2016 Medina ..... A63B 21/072
2007/0049469 A1 * 3/2007 Brown ..... A45C 3/00 482/93
2007/0135274 A1 * 6/2007 Blateri ..... A63B 21/075 482/109
2009/0062085 A1 * 3/2009 Polevoy ..... A63B 21/0783 482/93
2010/0048362 A1 * 2/2010 Liford ..... A63B 21/072 482/93
2010/0248910 A1 * 9/2010 DiLuglio ..... A63B 21/0602 482/93
2013/0244843 A1 * 9/2013 Burwell ..... A63B 21/075 482/108
2015/0045191 A1 * 2/2015 Carter ..... A63B 65/06 482/93
2015/0196792 A1 * 7/2015 Towley ..... A63B 21/075 482/93
2016/0107017 A1 * 4/2016 Pawlas ..... A63B 21/00065 482/93

OTHER PUBLICATIONS

Kettlebell Kings, "12-32KG Adjustable Competition Style Kettlebell", Retrieved from https://www.kettlebellkings.com/12-32kg-adjustable-competition-style-kettlebell/, Known to exist as early as Jan. 30, 2017, p. 7.
Kettlebell Kings, "10 to 40 lb Adjustable Kettlebell", Retrieved from https://www.kettlebellkings.com/10-to-40-lb-adjustable-kettlebell/, Known to exist as early as Jan. 30, 2017, p. 7.
Amazon, "MIR—Pro 83lbs Adjustable Kettlebell( From 10lbs to 83lbs )", Retrieved from https://www.amazon.com/Mir%C2%AE-83lbs-Adjustable-Kettlebell-10lbs/dp/B004QKW07Q/ref=sr_1_1?s=sporting-goods&ie=UTF8&qid=1458597331&sr=, Known to exist as early as Jan. 30, 2017, p. 7.
Rocketlok, "Rocketlok Adjustable Kettlebells", Retrieved from http://rocketlok.com/kettlebell.html, Known to exist as early as Jan. 30, 2017, p. 2.
Amazon, "Stamina X Adjustable Kettle Versa-Bell—36 lbs.", Retrieved from https://www.amazon.com/Stamina-Adjustable-Kettle-Versa-Bell-lbs/dp/B00HI1X9O1, Known to exist as early as Jan. 30, 2017, p. 7.

* cited by examiner

VARIABLE WEIGHT KETTLEBELL

PRIORITY

This application is a continuation of U.S. application Ser. No. 15/453,766, filed on Mar. 8, 2017 and entitled VARIABLE WEIGHT KETTLEBELL, and claims priority to U.S. Provisional Application No. 62/305,244, filed Mar. 8, 2016, entitled VARIABLE WEIGHT KETTLEBELL. The disclosures of each of the foregoing applications are incorporated herein by reference in their entireties.

FIELD OF THE DISCLOSURE

The present disclosure relates to variable or adjustable weight exercise devices. In particular, without limitation, the present disclosure relates to a kettlebell with removable weights.

BACKGROUND

The present disclosure pertains to exercise devices that may be configured to have one or more exercise weights inserted to change the total weight of the exercise device, such as variable weight kettlebells. Previous versions of variable weight kettlebells, such as those described in U.S. Pat. Nos. 7,563,208 and 7,052,445 have discontinuous outer surfaces, which makes the device unsuitable for exercises in which the kettlebell may come in contact with user's arm (e.g., "Turkish get-ups", "kettlebell snatches", etc.). Another issue with existing adjustable weight kettlebells is that as weights are added, the center of gravity of the device changes (as shown, for example, in U.S. Pat. No. 7,563,208), which makes it difficult to learn how to swing and move the device consistently as the weight of the device is changed. Other devices, such as those described in U.S. Pat. Nos. 6,387,022 and 7,381,157, require the user to partially disassemble the device in order to insert the weights. In addition, previous variable weight kettlebell inventions (e.g., U.S. Pat. No. 7,491,157 and U.S. Pat. Application No. US20130244843 A1) have weights added from the bottom or side of the kettlebell, which results in potential danger of the weights being ejected from the kettlebell when it is swung. Therefore, a need exists for a variable weight kettlebell exercise device that eliminates the aforementioned issues.

SUMMARY

An aspect of the present disclosure provides a kettlebell, which may comprise a main body configured to retain one or more removable exercise weights and a handle connected to the main body at two attachment points on a top side of the main body. The main body may have an opening disposed on the top side and between the two attachment points configured to receive the one or more removable exercise weights.

Another aspect of the disclosure provides a kettlebell, which may comprise a main kettlebell body having a hollow portion in a center of the main kettlebell body. The hollow portion may be configured to retain one or more removable exercise weights in one or more slots arranged side-by-side. The kettlebell may further comprise an opening on an exterior surface of the main kettlebell body configured to receive the one or more removable weights, and a restraint configured to cover the opening.

Yet another aspect provides a variable weight kettlebell system which may comprise a plurality of exercise weights and a kettlebell. The kettlebell may comprise a main body configured to hold one or more of the plurality of exercise weights, and a handle connected to the main body at two attachment points on a top side of the main body. The main body may have an opening disposed on the top side and between the two attachment points configured to accept the plurality of exercise weights.

BRIEF DESCRIPTION OF THE DRAWINGS

Some embodiments are now described, by way of example only, and with reference to the accompanying drawings. The same reference number represents the same element or the same type of element on all drawings.

FIG. 1 shows a variable weight kettlebell exercise device 100 comprising a weighted exterior body 150 (also referred to as a "main kettlebell body" throughout this disclosure) with a handle 120 attached at two points 124, 126 on top of the body. Throughout the disclosure, the variable weight kettlebell exercise device 100 may be referred to simply as a "kettlebell." The weighted kettlebell body may have an opening 130 in the top of the body, which may be located underneath and between the attachment points 124, 126 of the handle 120, that provides access to the interior cavity of the weighted body 150. The opening 130 allows additional exercise weights to be placed into the interior cavity of the weighted body 150. A receptacle (which will be described later in the disclosure) for the exercise weights may be located within the interior cavity of the weighted body 150. The exercise weight receptacle may be located substantially symmetrically in the three Cartesian directions about the center of the gravity of the kettlebell body. Additional exercise weights may be placed in the exercise weight receptacle in positions such that the center of gravity of the exercise device remains substantially unchanged.

FIG. 2 shows another embodiment of the kettlebell of the present disclosure. The the adjustable weight exercise device 200 may also include a restraint, such as a removable lid or cover assembly 260 that covers the cavity opening 230 and exercise weight receptacle and whose outer surface generally maintains the contour of the weighted kettlebell body 250. Throughout the disclosure, the terms "lid," "cover," "lid assembly," or "cover assembly" may be used interchangeably. In many embodiments, the lid assembly 260 also provides a retaining force or locking mechanism 270, which will be described in more detail later in the disclosure. The locking mechanism 270 may function to keep any added exercise weights inside the cavity when the kettlebell is swung overhead.

In some embodiments, the construction of the adjustable weight kettlebell may be accomplished by taking an intact kettlebell (which may be initially constructed by casting iron in one piece), cutting the handle off, and then cutting or machining a cavity into the main body of the kettlebell. Then, the handle would be securely reattached. FIG. 2 shows an embodiment of a kettlebell constructed in this way with flanges 282, 284 used to securely reattach the handle. In other embodiments, however, the cavity may be created without cutting or removing any handles. For example, a kettlebell in accordance with the disclosure could be cast or machined as one piece to begin with. FIG. 1, as well as several other figures in the drawings, show embodiments with an intact handle 120, illustrating a kettlebell constructed without flanges.

FIG. 3 shows a schematic transparent view of a kettlebell 300 in accordance with the present disclosure in an assembled state with a lid removed. The inside surface of the spherical kettlebell body may form a cavity 335 which is substantially spherical in shape, but other shapes may be used without departing from the scope of the disclosure. The variable weight kettlebell 300 has a main body 350, which contains various components in the interior, the cavity 335 may retain an exercise weight receptacle 340. When the lid/cover assembly is removed, one or more exercise weights 360 can be placed into the receptacle 340 The exercise weight receptacle 340 may remain empty during use or otherwise accommodate one or more exercise weights 360. The term "exercise weights" refers to additional weights, separable from the kettlebell weighted body, that may be added to the interior of the kettlebell in order to adjust the total weight of the kettlebell. Such exercise weights make the apparatus a "variable weight" kettlebell. The exercise weights 360 may be inserted through the opening 330 in the top of the kettlebell body 350 into the exercise weight receptacle 340 and secured by the lid/cover assembly to maintain the desired location of the exercise weight(s) 360 within the exercise weight receptacle 340.

Figure 1:
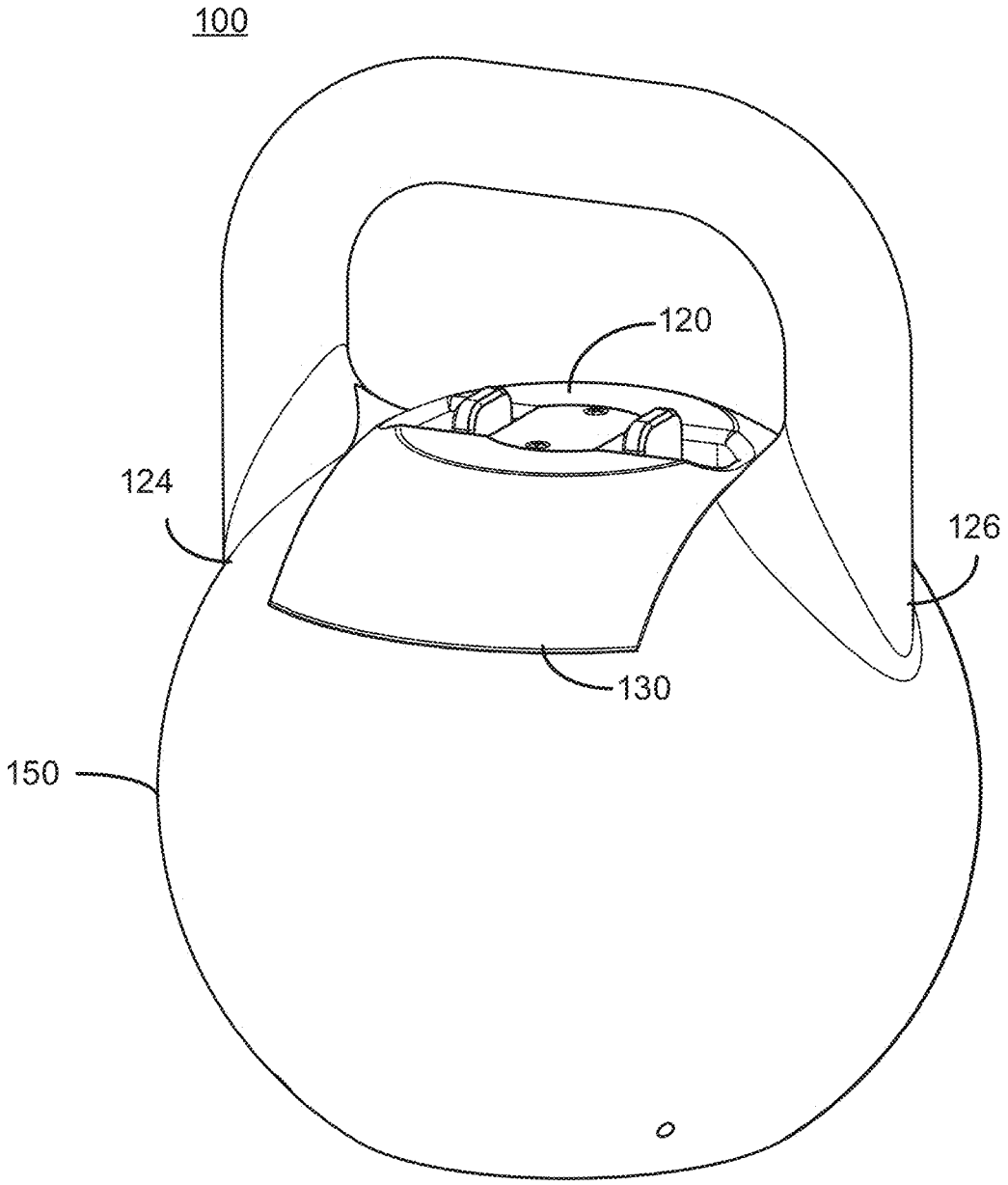
FIG. 1 shows a perspective view of a kettlebell in an embodiment of the present disclosure in assembled state with the lid/cover assembly in place.

In the embodiment shown, the main body 350 has a horizontal flat spot 390 on the bottom of the main body 350, which allows the device to rest in an upright position. In some embodiments a cover plate 385 can allow access to the interior cavity 335 through the bottom of the main body 350.

FIG. 4A-4D shows one embodiment of a shape of an opening 430 from top (FIG. 4A), side (FIG. 4B), front (FIG. 4C), and isometric (FIG. 4D) views. In this embodiment, the opening 430 may be symmetric relative to the midpoint of the handle 420 when viewed from the top, front, and side of the device, but it is contemplated that the opening could be any desired shape. The opening 430 in this embodiment has a complex three-dimensional shape, as shown in the isometric view of FIG. 4D. In this embodiment of the opening, the walls of the opening 430 (when viewed from the top, in FIG. 4A) are oriented perpendicular to the handle 420 and are vertical. The remaining two walls of the opening are curved. The opening may be made by a number of manufacturing methods which include, but are not limited to, casting the main body 450 with the desired shape and/or machining the main body 450 using hand tools or various motor operated machines. The main body 450 could also be made from multiple parts, and either with or without a flat spot on the bottom. If the main body 450 is made from multiple parts, the parts could then be joined by any number of standard methods and materials, suitable for the type of material used for the component parts. These methods and materials may include, for example, welding, adhesives, fasteners, etc.

FIGS. 5A-5D show another embodiment of a symmetric opening 530 from top (FIG. 5A), side (FIG. 5B), front (FIG. 5C), and isometric (FIG. 5D) views. The opening 530 is symmetric relative to the midpoint of the handle 520 when viewed from the top, front, and side of the kettlebell. The opening 530 has a complex three-dimensional shape as shown in the isometric view of FIG. 5D. In this embodiment, the opening 530 is rectangular when viewed from the top view, because all four walls of the opening 530 are vertical. Other non-symmetric or symmetric opening shapes could be used.

Figure 6:
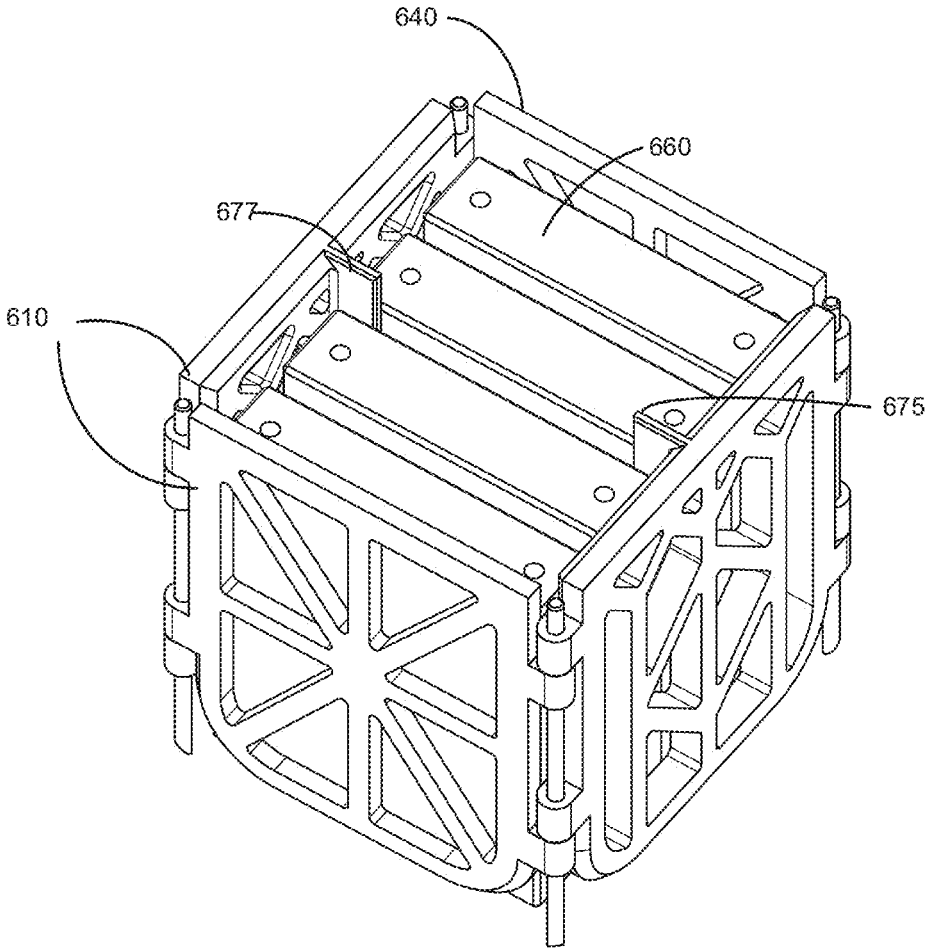
FIG. 6 shows an exercise weight receptacle with inserted exercise weights.

FIG. 6 shows an embodiment of an exercise weight receptacle 640 with exercise weights 660 disposed within. The walls 610 of the exercise weight receptacle 640 may contain features shaped to locate the exercise weights 660 in a symmetric manner within the interior of the kettlebell cavity (front to back, side to side, up and down) such that the center of gravity of the weighted kettlebell remains in substantially the same position regardless of whether exercise weights are present or not. Such features may include, for example, slots defined by guide fins 675, 677. These features, and the overall configuration of the exercise weight receptacle 640, allows the weights to be disposed in a side-by-side configuration. Placing the weights side-by-side may provide advantages in maintaining the center of gravity in the middle of the kettlebell body as weights are added. The center of gravity of the weighted body alone may lie directly under the center of the handle. If the weighted kettlebell body is substantially spherical, the center of gravity of the spherical body would be coincident with the geometric center of the spherical body. If any exercise weights are added in a symmetric manner relative to the center of gravity of the weighted kettlebell, the center of gravity of the weighted body will not change (or will only change very slightly) as exercise weights are added. Having the center of gravity remain in the same place as the weight of the exercise device changes is an advantageous feature for users because it makes it easier for them to learn how to use the exercise device. Filling material of desired weight and consistency can also be placed in the kettlebell cavity between the exercise weight receptacle and the inner wall of the cavity to set the base weight of the kettlebell.

Figure 7:
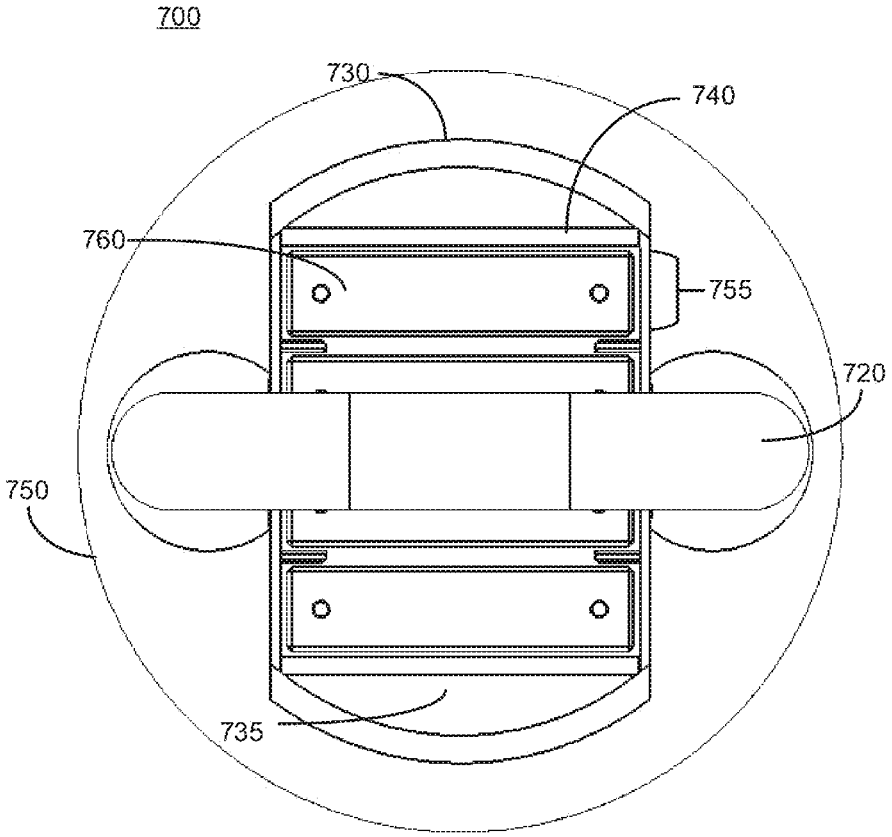
FIG. 7 shows a top view of a kettlebell of the present disclosure with weights inserted in the exercise weight receptacle parallel to the handle.

FIG. 7 shows a top view of a variable weight kettlebell 700 with the lid/cover assembly removed. In this embodiment, the exercise weight receptacle 740 allows for exercise weights 760 to be placed into exercise weight slots 755 in the receptacle 740 with the weights 760 oriented parallel to the handle. In this embodiment, the opening 730 has the shape shown in FIGS. 4A-4D, but it could also have the shape shown in FIGS. 5A-5D, or some other shape. A key feature of this disclosure is that the exercise weights 760 can be placed into the exercise weight receptacle 740 in positions substantially symmetric about the center of gravity of the main body 750 of the kettlebell in the cavity 735. This also means that the center of the exercise weight receptacle is substantially directly under the center of the kettlebell handle 720. Weights 760 could be added in a non-symmetric manner of course, which would result in the center of gravity of the main body 750 changing position.

In some embodiments, the interior kettlebell cavity may be rectangular, and the exercise weights can be inserted in either of two directions: either parallel or perpendicular to the handle. Referring back to FIG. 6, the exercise weights 660, for example, may have a distinct shape that allows them to be inserted without interference into the cavity. In many embodiments, rectangular "brick" shaped exercise weights, such as exercise weights 660, may be used and inserted into an exercise weight receptacle with the exercise weight slots oriented parallel to the handle. Some exercise weights that may be used with the kettlebell may be differently weighted but may have the same external dimensions, in order to allow for a greater degree of variation of weight. For example, a four-pound exercise weight may have the same external dimensions as a two-pound exercise weight and both may fit into the same exercise receptacle slot. In order to achieve this weight variation, some exercise weights may have material removed from the inner portion to reduce the mass of the exercise weights. In some embodiments, the exercise weights may also have a gripping feature, such as a handle or a cavity formed in the exercise weight to accommodate fingers, in order to facilitate their extraction from the cavity.

Different mass exercise weights 760 may be placed in the slots of the exercise weight receptacle 740 (for example, 1 kg or 2 kg mass weights). For the purposes of the present disclosure, the term "mass" is equivalent to "weight." If different mass exercise weights 760 are used, the same mass exercise weight 760 would need to be placed in the exercise weight receptacle slot/position mirrored about the center of the exercise weight receptacle 740 if the center of gravity were to remain unchanged.

Figure 8:
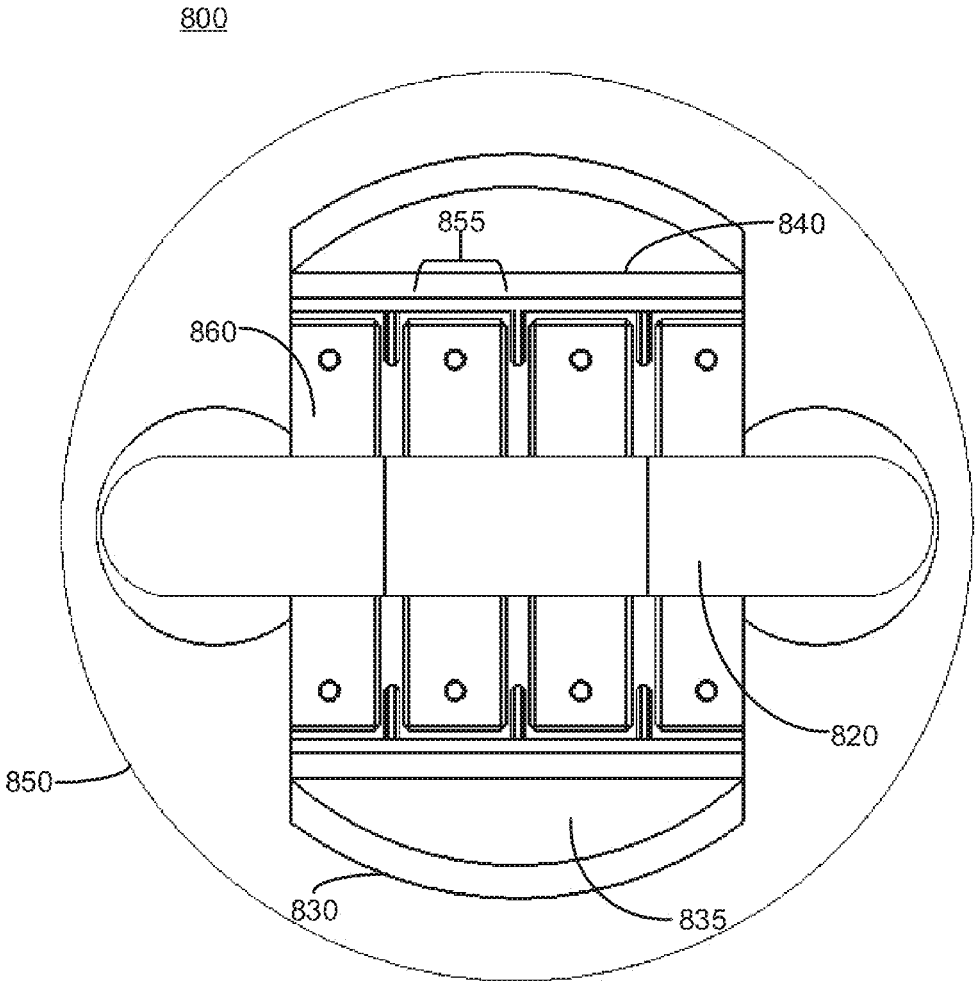
FIG. 8 shows a top view of a kettlebell of the present disclosure with weights inserted in the exercise weight receptacle perpendicular to the handle.

Other orientations of weights symmetrically oriented about the center of the gravity of the main body of the kettlebell are possible. For example, FIG. 8 shows a top view of a variable weight kettlebell 800 with the lid/cover assembly removed. In this embodiment, the exercise weight receptacle 840 allows for exercise weights 860 to be placed into exercise weight slots 855 in the receptacle 840 with the weights 860 oriented perpendicular to the handle 820. In this embodiment, the opening 830 has the shape shown in FIGS. 4A-4D, but it could have the shape shown in FIGS. 5A-5D, or some other shape. The embodiment of FIG. 8 further illustrates a key feature of this disclosure, which is that the exercise weights 860 can be placed into the exercise weight receptacle 840 in positions substantially symmetric about the center of gravity of the main body 850 of the kettlebell in the cavity 835. It is contemplated that many other symmetric positions of the exercise weights 860 could be used in the exercise weight receptacle 840. In such positions, the center of the exercise weight receptacle 840 may be substantially directly under the center of the kettlebell handle 820. Weights 860 could be added by a user in a non-symmetric manner of course, which would result in the center of gravity of the main body 850 changing position.

In both of the embodiments shown in FIGS. 7 and 8, the exercise weight receptacle has an even number of slots (i.e., four) to place exercise weights into. When the exercise weight receptacle has an even number of slots in which to place exercise weights, equal mass exercise weights could be added or removed in pairs in positions mirrored about the center of the exercise weight receptacle. Such positions would keep the center of gravity of the main body in the same unchanged position regardless of the number of weights added (if any weights are added). This makes it easier for the user to learn how to swing the variable weight kettlebell since the center of gravity of the main body is in substantially the same location regardless of the number of exercise weights that are in place. Many embodiments of the exercise weight receptacle have an even number of slots into which weights may be placed.

In other embodiments, the exercise weight receptacle may have an odd number of exercise weight slots instead of an even number, which may facilitate minimizing any displacement of the center of gravity. In such embodiments, exercise weights must be added or removed such that the center of gravity of the main body remains in the same position regardless of the number of weights added (if any are added). For example, if there were five exercise weight slots (instead of the four slots shown in FIGS. 7 and 8) oriented parallel to the handle, the weights could be located symmetrically about the center of gravity of the main body, with one of the slots located directly under the handle with two slots located on either side of the center slot. This arrangement would allow for a single weight to be added to the center slot or not. A weight added here would be substantially symmetric to the center of gravity of the main body. Regardless if any weight is added to the center slot, equal mass exercise weights could be added or removed in pairs in positions mirrored about the center slot of the exercise weight receptacle if it was desired to keep the center of gravity of the main body unchanged with the exercise weights added. In is contemplated that other symmetrically shaped weight receptacles with an odd number of slots are possible. In this particular case, where the slots occupy the full width of the weight receptacle, an odd number of full width slots can be viewed as a symmetrically shaped weight receptacle with an even number of slots plus one additional slot in the center of the weight receptacle.

Figure 9A:
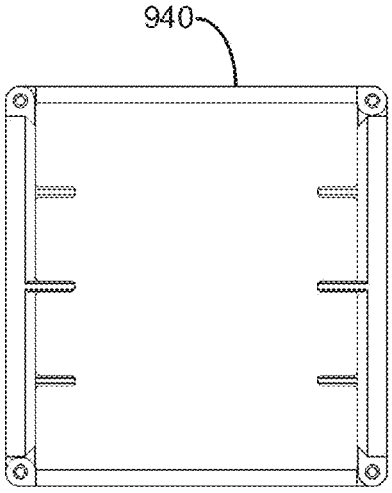
FIGS. 9A-9C show views of the exercise weight receptacle from top, side, and isometric views, respectively.
Figure 9B:
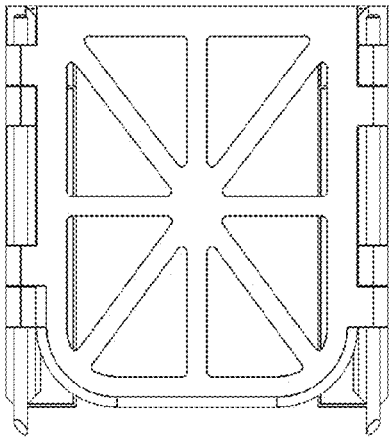
Figure 9C:
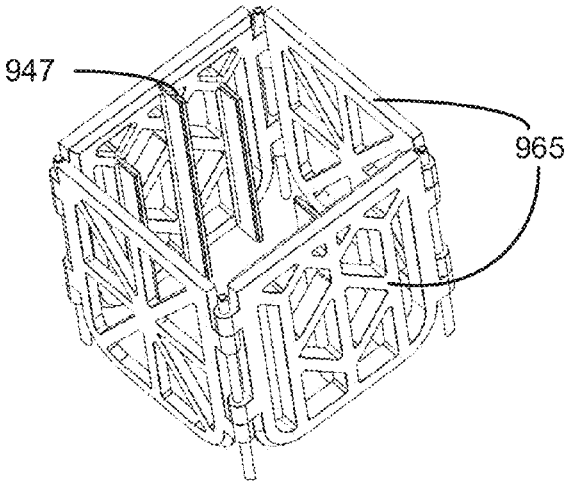

FIGS. 9A-9C show views of an exercise weight receptacle 940 of the present disclosure. which may be located in the main body 14 of the kettlebell. FIG. 9A shows a top view, FIG. 9B shows a side elevation view, and FIG. 9C shows an isometric view. In the embodiment shown, the shape of the weight receptacle 940 is substantially symmetric in the three Cartesian directions about the center of the gravity of the main body. One embodiment shape for the symmetric weight receptacle 940 is a rectangular cuboid as shown in FIGS. 9A-9C. However, other shapes of the exercise weight receptacle could satisfy the same requirements of symmetry. It should be noted that the center of mass of the exercise weight receptacle 940 is substantially coincident with the geometric center of the main body for a spherically shaped main body. The walls 965 can be separate pieces attached to the cavity by any number of standard practices, depending on the type of material, for example, welding, adhesives, fasteners, etc. Or the walls 965 can be an integral part of the main body of the kettlebell, formed by, for example, casting. FIG. 9 shows only one embodiment. It is contemplated that they can be solid surfaces or have any number of cutouts or other variations.

Figure 10:
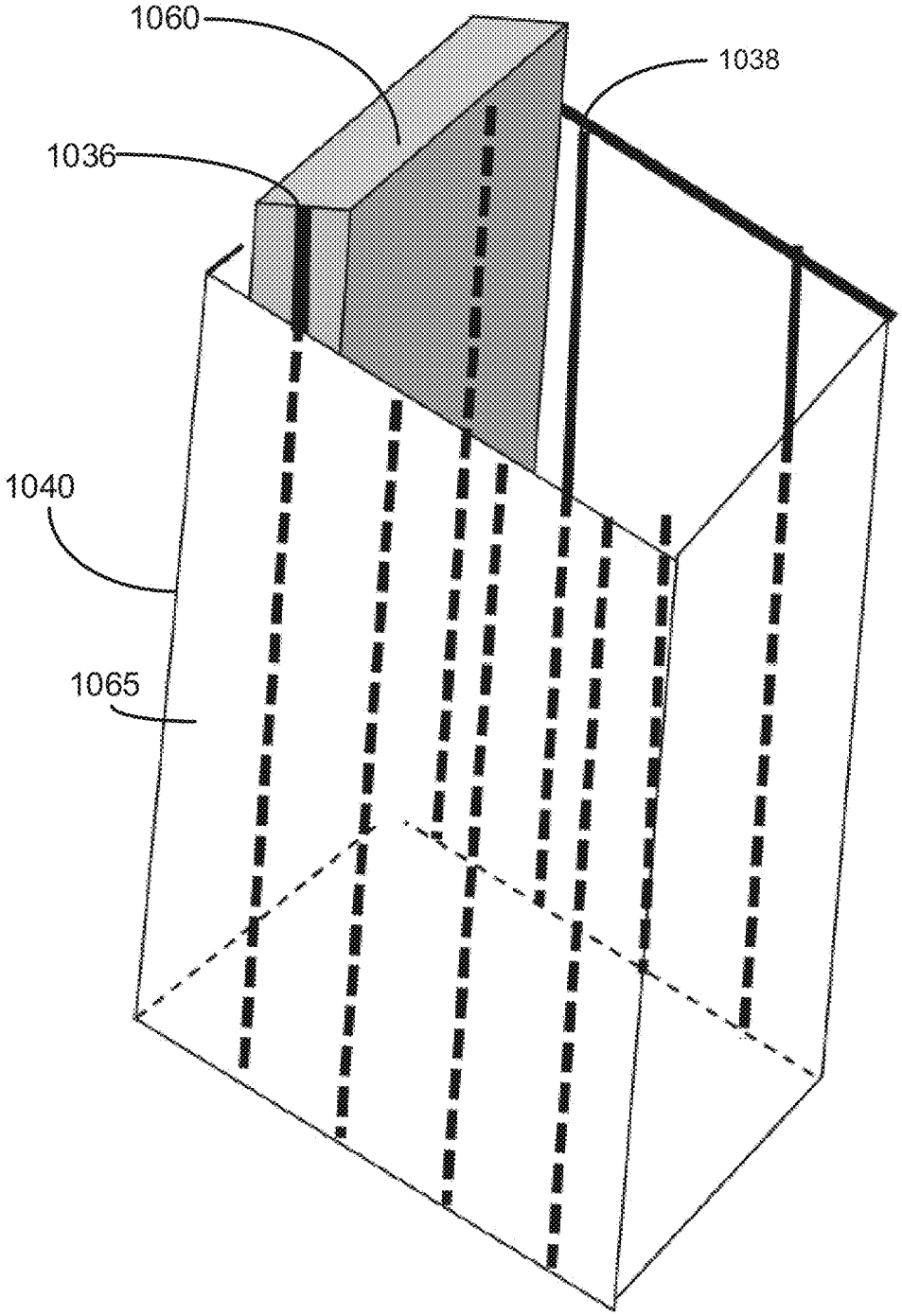
FIG. 10 shows a schematic view of an embodiment of an exercise weight receptacle and exercise weight of the present disclosure.

Various methods can be utilized to guide and locate the exercise weights into the proper positions within the exercise weight receptacle 940. For example, in the embodiment shown in FIG. 9A-9C, guide fins 947 and the walls 965 can create a slot that positions the exercise weights into the desired location. FIG. 10 shows an alternative configuration in which exercise weights may be positioned. As shown, grooves 1036 on the exercise weights 1060, and ribs 1038 on the walls 1065 position the weights 1060 in the desired location. The guide fins, grooves and ribs could have any of a number of cross-sectional shapes and or dimensions. If grooves 1036 and ribs 1038 were used as shown in FIG. 10, then the exercise weight 1060 would have one of the features (e.g. groove 1036) while the wall would have the corresponding opposite feature (in this case rib 1038). Other methods and mechanisms of guiding the exercise weights into place are also possible (guide pins sticking out from receptacle walls 1065, etc.) for locating the exercise weights in the desired locations. The proper vertical location of the exercise weights 20 could be achieved in a number of ways, which include, but are not limited to, putting a floor on the bottom of the exercise weight receptacle 1040, putting a substance of the desired height on the floor of the main body of the kettlebell, or adding structures on the floor of the main body of the kettlebell.

Figure 11:
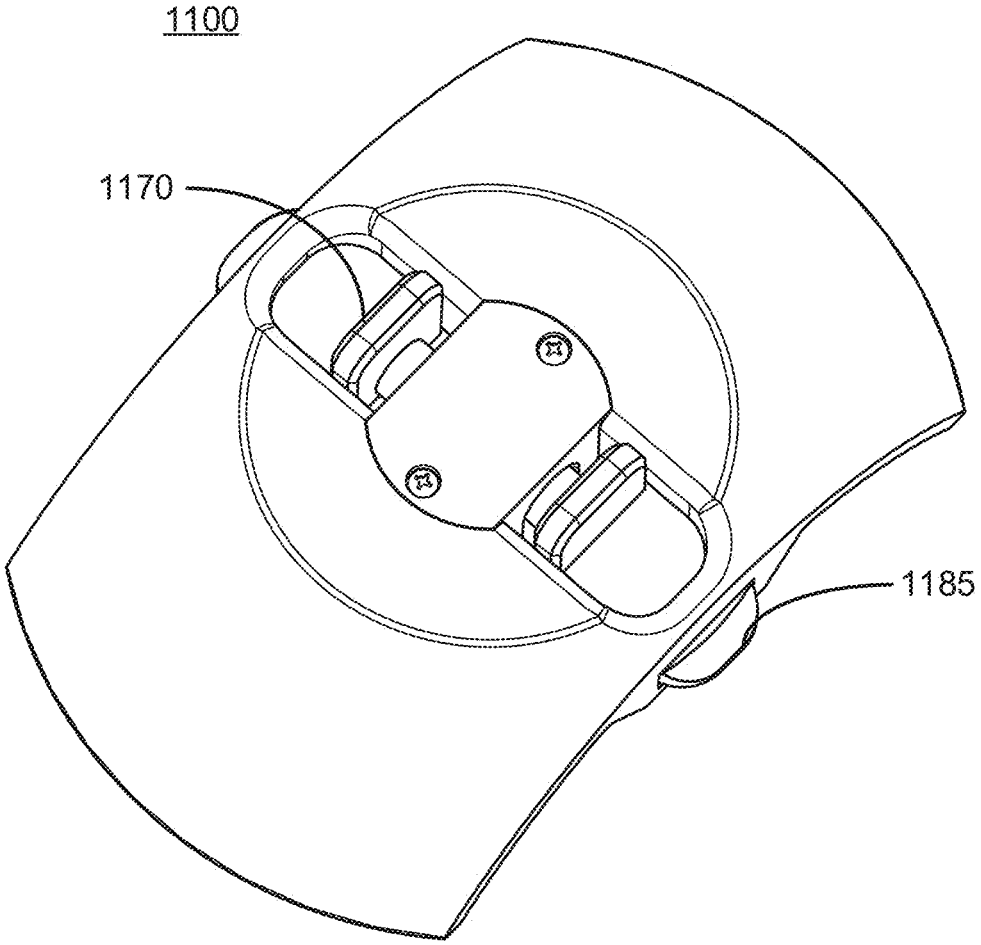
FIG. 11 shows a top perspective view of a lid/cover assembly of the present disclosure.

In some embodiments, the lid/cover assembly provides a mechanism to provide a desired amount of retaining force to retain the exercise weights in the exercise weight receptacle. FIG. 11 shows a top perspective of a lid assembly 1100 comprising a retaining mechanism 1170. This mechanism provides locking tongues 1185 that are configured to engage with the inner surface of the kettlebell cavity. The stiffness of the outer surface of the lid/cover assembly 1100 can vary according to the material used to construct it. In some embodiments, the material may be selected to provide a comfortable feel for the user of the invention. This can be advantageous because the kettlebell surface may contact the user's arm when the kettlebell is swung during exercises such as the kettlebell snatch.

Figure 2:
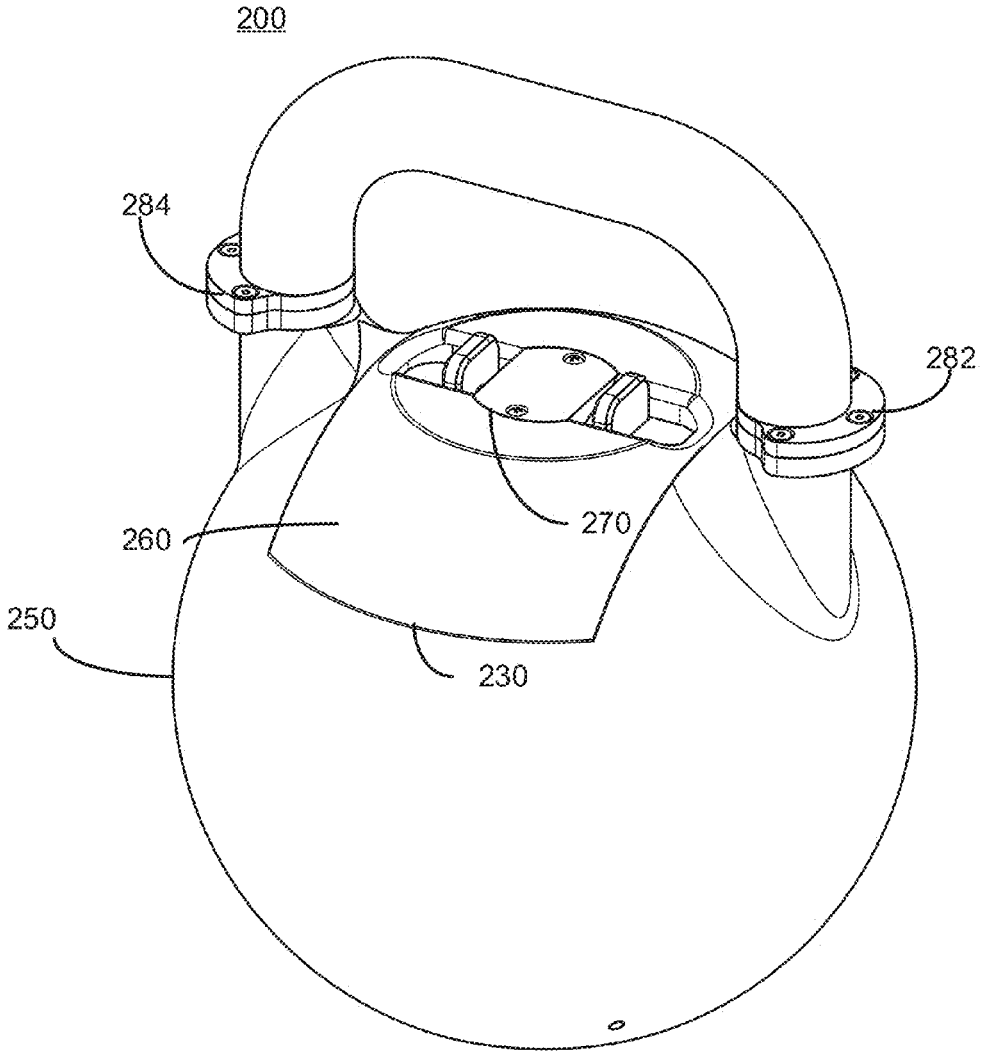
FIG. 2 shows a perspective view of a kettlebell in another embodiment of the present disclosure in assembled state with the lid/cover assembly in place
Figure 3:
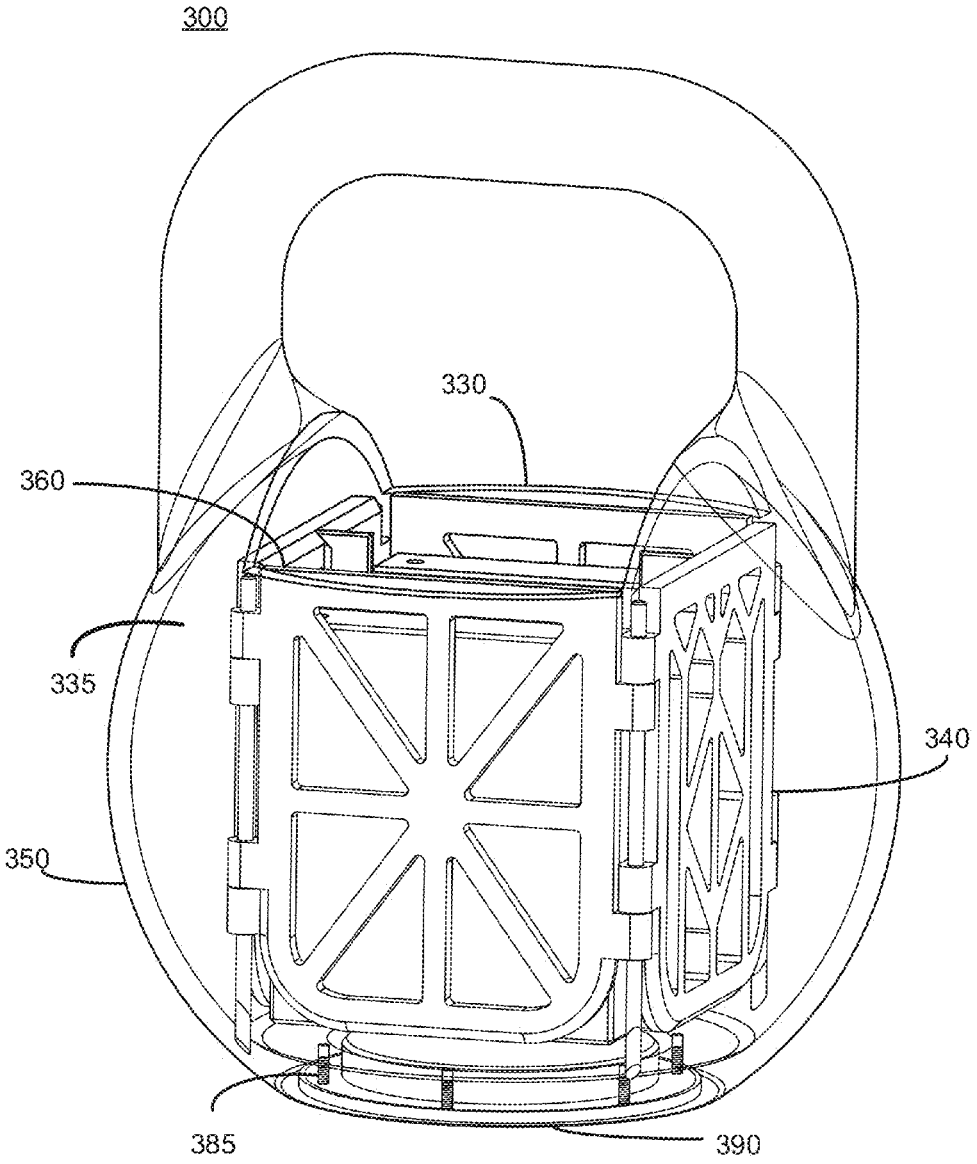
FIG. 3 shows a partially transparent view of a kettlebell in an embodiment of the present disclosure with a lid removed
Figure 4A:
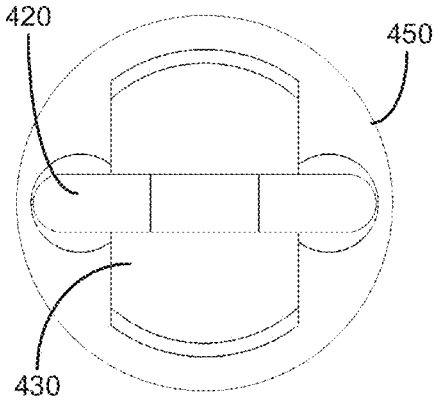
FIGS. 4A-4D shows an embodiment of the present disclosure from top, side, front, and isometric views, respectively, illustrating a shape of an opening on the top of the kettlebell.
Figure 4B:
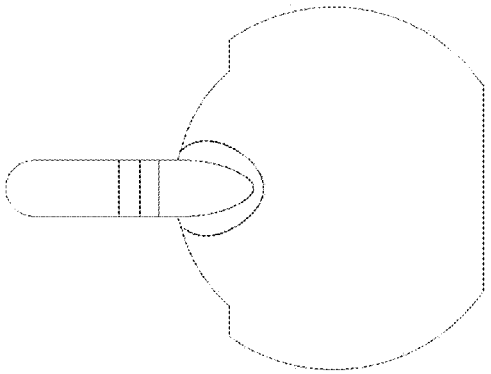
Figure 4C:
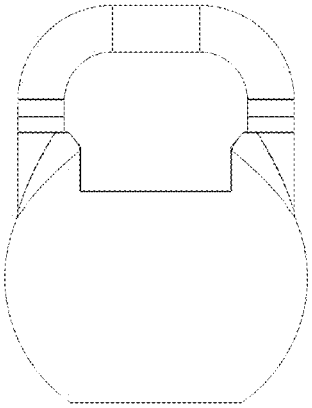
Figure 4D:
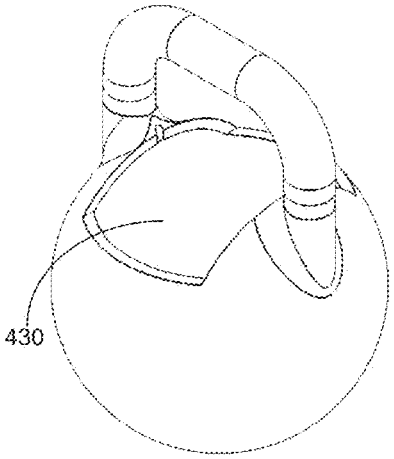
Figure 5A:
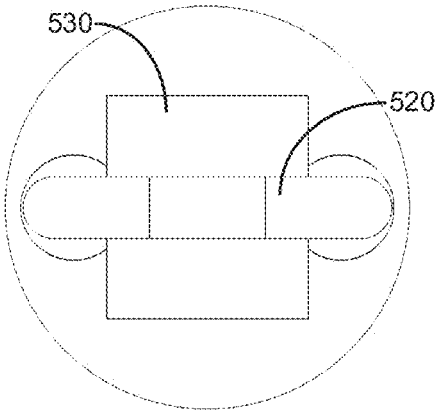
FIGS. 5A-5D shows another embodiment of the present disclosure from top, side, front, and isometric views, respectively, illustrating another shape of an opening on the top of the kettlebell.
Figure 5B:
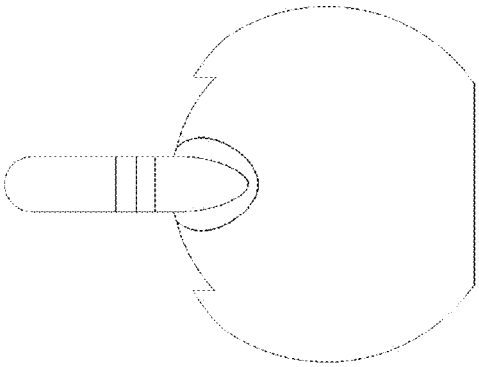
Figure 5C:
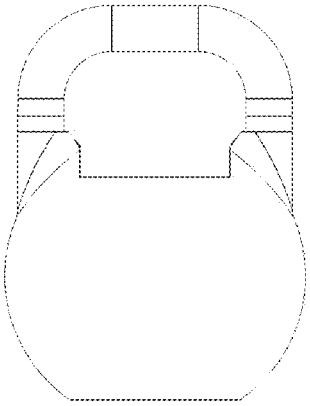
Figure 5D:
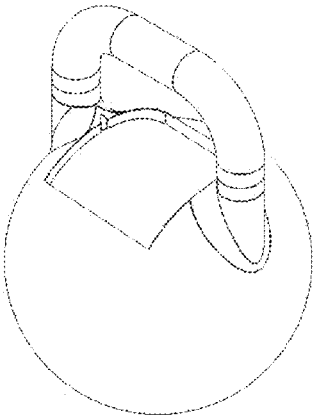
Figure 12A:
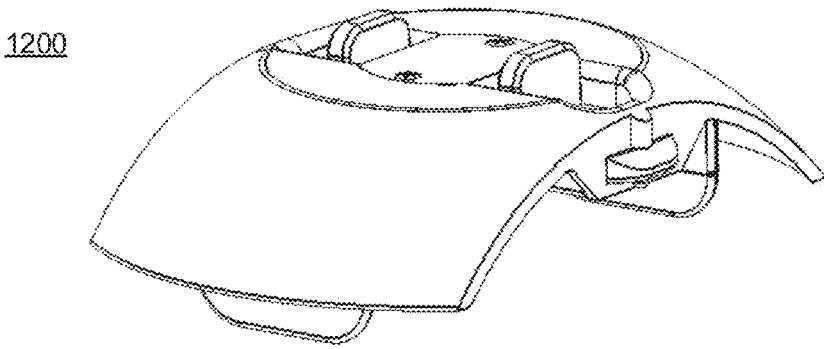
FIGS. 12A-12C show an embodiment of a lid/cover assembly of the present disclosure using isometric, exploded, and cross section views, respectively.
Figure 12B:
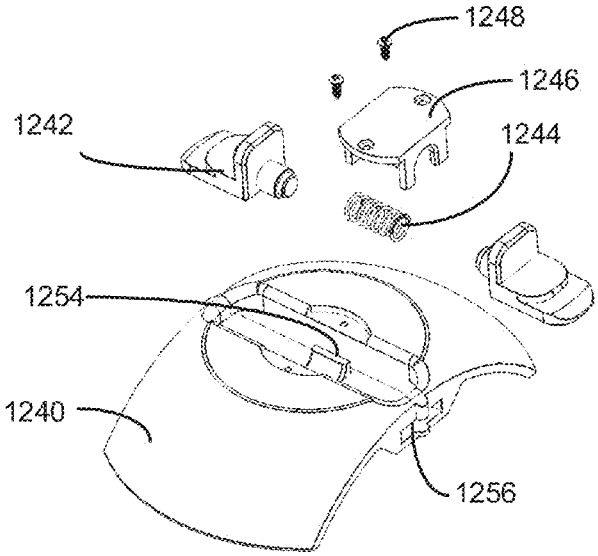
Figure 12C:
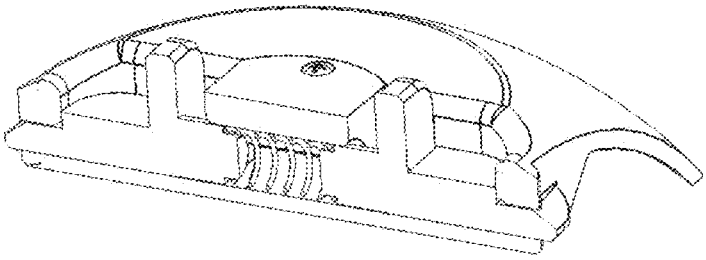

FIGS. 12A-12C show isometric, exploded, and cross-sectional views, respectively, of an embodiment of the lid/cover assembly 1200. Another aspect of this disclosure is that the top or outer surface of the lid/cover assembly 1200 maintains the outer contours of the main kettlebell body. This shape protects the exerciser user's forearm when performing exercises, such as those known as "Turkish get-ups" and "kettlebell snatches," during which the main body can come into contact with the user's forearm. In this embodiment, the outer surface of the main body retains the substantially spherical contours of the kettle bell shown in FIGS. 1 and 2. Other outer shapes are possible and are chosen to match the contours of the main kettlebell body. Spring loaded locking "tongues" 1242, which may be engaged and retracted by a spring 1244, protrude out the sides of the lid/cover assembly main body 1240. The tongues 1242 may engage with and into the cavity and opening of the kettlebell main body to provide another key feature of this disclosure, which are methods to both position/align the lid/cover assembly 1200 and provide a retaining force for any added exercise weights.

Two locking tongues 1242 may sit and slide in a channel. The tongues 1242 protrude through the tongue opening 1256. A guide spring 1244 sits in the same channel, on top of the spring guide 1254, and between the ends of two locking tongues 1242. One side of the tongue has a feature to engage with the spring 1244 while the opposite side of the tongue is appropriately shaped to engage with the cavity and/or opening of the kettlebell. The spring loaded engagement of the tongue 1242 with the cavity and/or opening provides a downward force to keep the lid/cover assembly 1200 in place. The spring 1244 is sized to provide a desired amount of force such that the exercise weights will not displace the lid/cover assembly 1200 if the kettle bell is turned upside down. A cover 1246 and fasteners 1248 position and hold the spring 1244 and tongues 1242 in the proper location. The tongue opening 1256 provides a slot for the tongue 1242 to slide in. The cover 1246 and tongue opening 1256 are dimensioned such that the tongues 1242 cannot be removed unless the cover 1246 is removed (as shown in cross section view on FIG. 12C).

The top of the tongue 1242 as shown has a tab or "handle" that protrudes vertically upward. This allows the user to retract the tongue 1242 from its fully extended position by exerting a sideways force on the tab. In the isometric view shown in FIG. 12A, the tongue is shown in its default fully extended position. The tongue 1242 is pushed outward by the spring 1244 which remains under compression over its range of positions. The user may actively retract each tongue 1242 by exerting a sideways force towards the center of the lid/cover assembly 1200. When the tongues are retracted the lid/cover assembly 1200 may be removed. A benefit of constructing a lid assembly in this manner is that the lid strongly resists accidental removal and prevents the exercise weights from accidentally falling out or being thrown out.

Other methods and apparatuses are possible to position and remove the lid/cover assembly 1200. For example, a handle or another method of exerting a vertical force on the top of the lid/cover assembly could be employed in place of the tabs on the locking tongues. This would enable the user to simply pull up to remove the lid or push down to engage the lid. It is contemplated that these mechanisms may also prevent accidental removal of the lid.

FIGS. 13A-13*d* shows top, side, front, and bottom views, respectively of a fully assembled lid/cover assembly 1300. The locking tongues 1342 are in the fully extended position in all views. Also visible in the bottom view are optional support ribs 1358. A variety of manufacturing methods and materials can be used to make the parts.

Figure 13A:
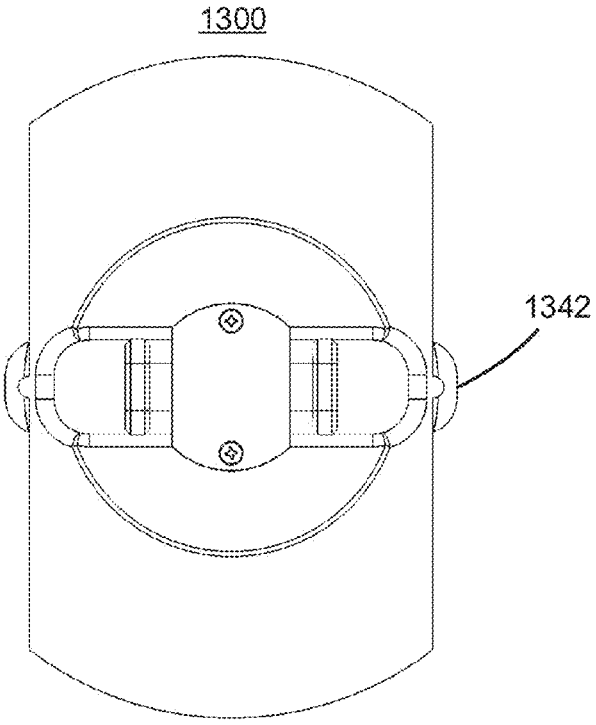
FIGS. 13A-13D shows an embodiment of a fully assembled lid/cover assembly of the present disclosure using top, front, side, and bottom views.
Figure 13B:
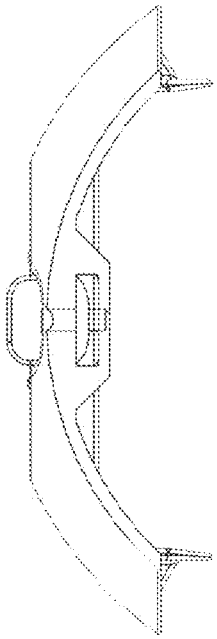
Figure 13C:
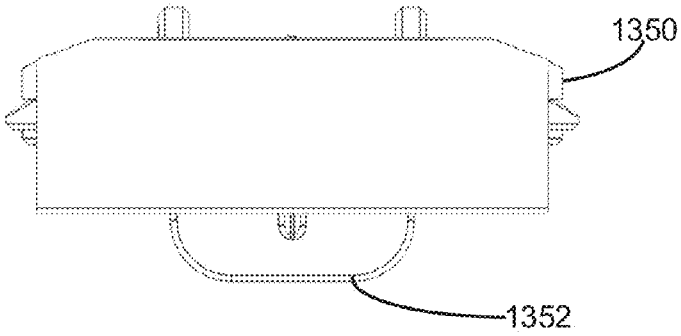
Figure 13D:
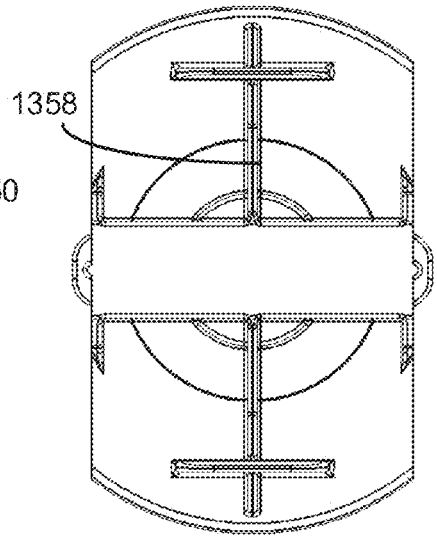

Optional features, shown most clearly in FIG. 13C, may be implemented to help align and maintain the position of the lid and include the alignment feature (rib) 1350 and/or alignment fin 1352. The alignment feature 1350 may engage with a mirror image feature (visible in FIG. 2, for example) on the opening or cavity of the kettlebell. The alignment feature 1350 can be a "rib" or a "groove" with a corresponding mating feature being in the opening or cavity. The cross sectional shape of the features 1350 and 1352 can be any number of shapes. For example, the cross sectional shape of feature 1350 could be a hemisphere or a triangle while the cross section of fin 1352 could be rectangular resulting in a shape as shown or circular resulting in a cylindrical pin or post. One recognizes that either, none, or both features could be used and have a variety of dimensions.

In some embodiments of the kettlebell of the present disclosure, the handle can be removable such that different shape (e.g. diameter, width, height, etc.) handles can be used. For example, a 33 mm diameter handle may be desirable for users with smaller hands, or a 35 mm diameter handle for users with bigger hands. Turning back to FIG. 2, one embodiment of a multi-part removable handle using flanges and fasteners to affix the handle to the main body is shown. Such flanges may be assembled and disassembled to interchange different size handles. In other embodiments, the removable handles may allow easier insertion and removal of exercise weights. Any variety of other methods could be used to attach the flanges to the handle and main body, such as welding, for example.

One or more additional methods to provide a retaining force for all the exercise weights at once or each individual weight can be provided to retain any added exercise weights within the exercise weight receptacle and the cavity. Such a retaining force may be used as an extra safety precaution to prevent the exercise weights from accidentally falling out of the exercise weight receptacle in the event that the lid breaks or fails. One embodiment may have a flexible strap and closure (such as a plastic buckle) that is attached to a desired position below the lid assembly, such as to the top of the exercise weight receptacle, opening, or cavity and provides a closure and retaining force above the top of all of any added exercise weights. Other methods and mechanisms are contemplated that could be used to provide retaining force to each of the exercise weights if desired, including, magnets, ball plungers/detents, locking cams, etc. One or a combination of methods could be employed in the receptacle to engage with the exercise weights.

Figure 14:
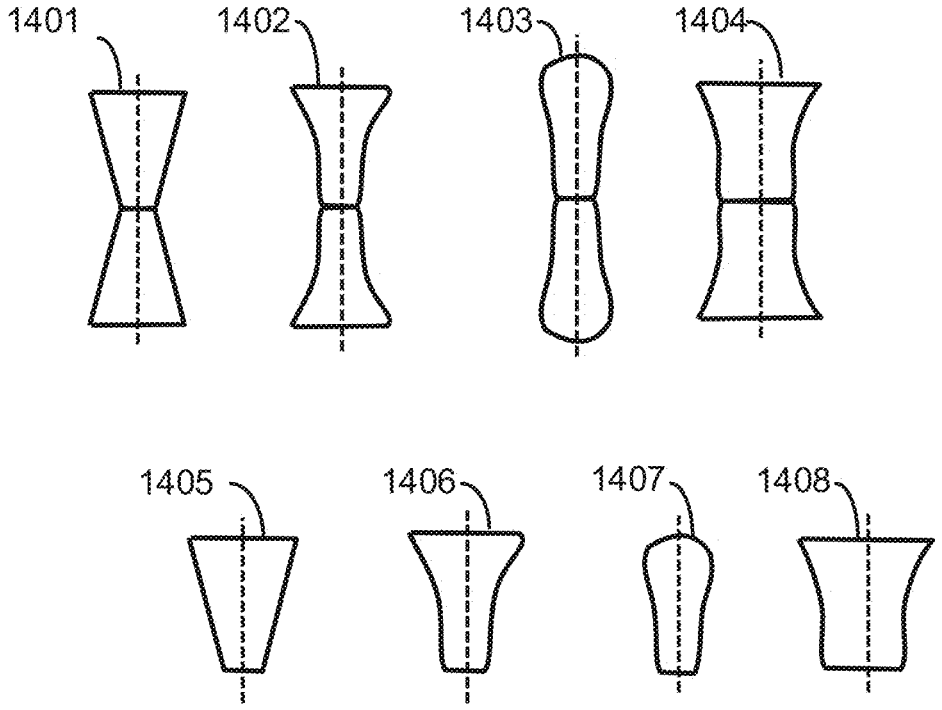
FIG. 14 shows several shapes of exercise weight shapes that may be utilized in the present disclosure.

In many embodiments, the exterior shape of the exercise weights may be the same regardless of the mass of the exercise weight. One exemplary shape of exercise weight is a "brick" (rectangular cuboid), as shown in the exercise weight receptacles shown in FIGS. 6, 7, and 8. As noted before, different mass exercise weights could be used (e.g., 1 kg and 2 kg mass weights). In some embodiments, exercise weights with less dense material could be used to make lighter exercise weights while maintaining the same perimeter shape of all weights. Having all of the weights, regardless of mass, be the same size as each other is advantageous because they may all be inserted into the same sets of slots in the same manner. A different shape other than a "brick" may be necessary or desired, for example to insert weights into the exercise weight receptacle shown in FIG. 8 in which the weight slots 855 are oriented perpendicular to the handle 820. In a case like this, weight insertion may be more problematic because it requires clearance under the handle 820 and above the opening 830 at some angle. As a result, other shapes that accommodate the need for clearance may be used. FIG. 14 shows side elevation views of exercise weights 1401-1408 having a variety of outer dimensions and/or overall perimeter shape (not limited to these shapes) that could be used in embodiments of the present disclosure.

Figure 15A:
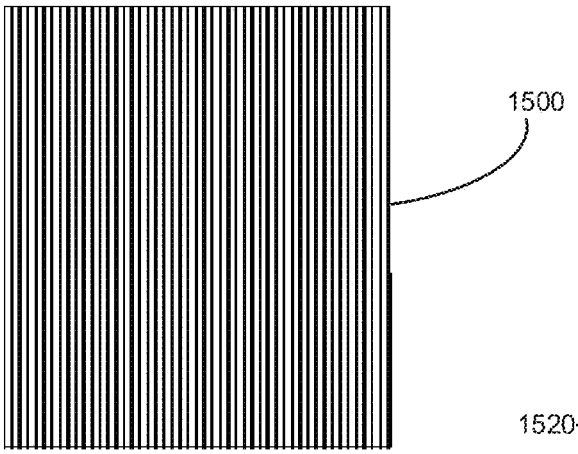
FIGS. 15A-15C shows embodiments of exercise weights that may be used to reduce the mass of exercise weights while retaining the same center gravity location and perimeter shape.
Figure 15B:
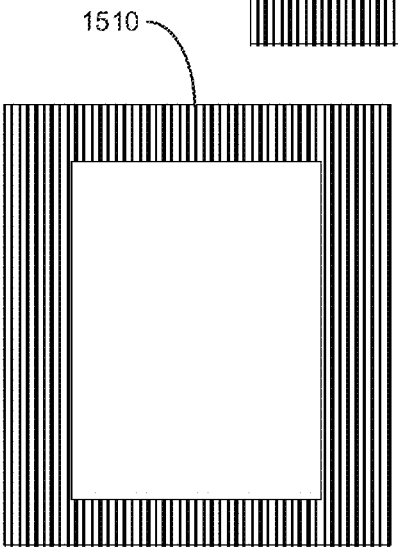
Figure 15C:
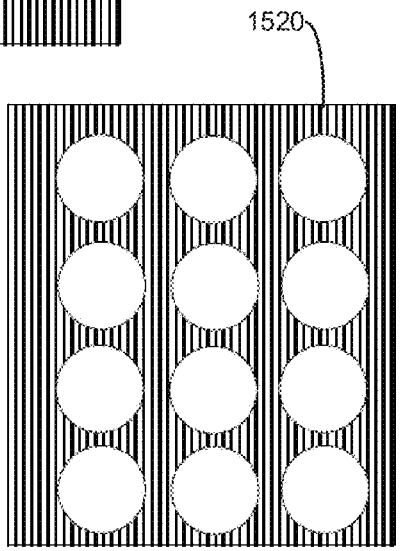

Another way to accomplish having weights of different mass (rather than changing the density of the material) is shown in FIGS. 15A-15C. FIG. 15A shows a side view of a rectangular exercise weight made of a solid material. FIGS. 15B and 15C show exercise weights 1510, 1520 that have material removed from the inner portion of the weight to reduce the mass of the exercise weight. In the embodiments shown, the inner material is removed (or the weight is constructed) in such a manner that the center of gravity of the exercise weights 1510, 1520 remains in the center of the weight. As shown, the outer perimeters of each of the weights 1500, 1510, and 1520 are the same shape, which would allow each of them to fit in the same weight receptacle or slot in the same way.

The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present invention is not intended to be limited to the embodiments shown herein but is to be accorded the widest scope consistent with the principles and novel features disclosed herein.

What is claimed is:

1. A kettlebell comprising:

a main body configured to retain one or a plurality of removable exercise weights, a handle fixedly connected to the main body at two separate attachment points on a top side of the main body, the two separate attachment points having a distance between them;

wherein the main body has an opening disposed on the top side, the opening having a width confined within the distance between the two separate attachment points of the handle, and the opening configured to receive the one or the plurality of removable exercise weights; wherein an inside surface of the main body forms a cavity which is substantially spherical in shape; and wherein the kettlebell is rigidly constructed.

2. The kettlebell of claim 1, further comprising a restraint configured to cover at least a portion of the opening and retain the one or the plurality of removable exercise weights inside the main body.

3. The kettlebell of claim 2, wherein the restraint comprises a removable lid separate from the handle.

4. The kettlebell of claim 3, wherein the removable lid comprises:

a spring; and two sliding latches disposed on either side of the spring, the sliding latches configured to engage with notches in the kettlebell when the spring is extended and to disengage with the notches in the kettlebell when the spring is compressed.

5. The kettlebell of claim 1, wherein the main body further comprises a weight receptacle configured to retain the one or the plurality of removable exercise weights in an upright position.

6. The kettlebell of claim 5, wherein the weight receptacle is configured to retain the plurality of removable exercise weights, wherein each of the plurality of removable exercise weights is rectangular.

7. A kettlebell comprising:

a main kettlebell body having a hollow portion in a center of the main kettlebell body, wherein the hollow portion is configured to retain one or a plurality of removable exercise weights in one or a plurality of slots arranged side-by-side;

an opening to the hollow portion on an exterior surface of the main kettlebell body configured to receive the one or the plurality of removable exercise weights;

a handle fixedly attached at two separate attachment points to the main kettlebell body outside of the opening; and a restraint configured to cover the opening.

8. The kettlebell of claim 7, wherein the restraint is shaped to match an exterior surface contour of the kettlebell.

9. The kettlebell of claim 7, wherein the restraint is completely removable from the kettlebell body.

10. The kettlebell of claim 7, wherein the hollow portion is configured to retain a first of the one or the plurality of removable exercise weights in the center of the main kettlebell body and still have space for a second of the one or the plurality of removable exercise weights on at least two sides of the first of the one or the plurality of removable exercise weights.

11. The kettlebell of claim 10, wherein the hollow portion is configured to retain the plurality of removable exercise weights, wherein each of the plurality of removable exercise weights is rectangular.

12. A variable weight kettlebell system comprising:

a plurality of exercise weights; and a kettlebell comprising:

a main body configured to hold one or a plurality of the plurality of exercise weights, and a handle fixedly connected to the main body at two separate attachment points on a top side of the main body, the two separate attachment points having a distance between them;

wherein the main body has an opening disposed on the top side, the opening having a width confined within the distance between the two separate attachment points of the handle, and the opening configured to accept the plurality of exercise weights; wherein an inside surface of the main body forms a cavity which is substantially spherical in shape; and wherein the kettlebell is rigidly constructed.

13. The variable weight kettlebell system of claim 12, further comprising:

a removable lid configured to cover the opening and lock the one or the plurality of the plurality of exercise weights within the opening.

14. The variable weight kettlebell system of claim 13, wherein the removable lid comprises a padded material on an underside of the lid configured to be in contact with the one or the plurality of the plurality of exercise weights when the removable lid is in place.

15. The variable weight kettlebell system of claim 13, further comprising a restraint.

16. The variable weight kettlebell system of claim 15, wherein the restraint is disposed under the removable lid.

17. The variable weight kettlebell system of claim 12, further comprising a weight receptacle structure within the main body, the weight receptacle structure configured to hold the one or the plurality of the plurality of exercise weights in a stationary position when the kettlebell is moved.

18. The variable weight kettlebell system of claim 12, wherein the plurality of exercise weights are rectangular.

19. The variable weight kettlebell system of claim 12, wherein the plurality of exercise weights are each the same size.

* * * * *